US007293380B2

(12) United States Patent
Repecki

(10) Patent No.: US 7,293,380 B2
(45) Date of Patent: Nov. 13, 2007

(54) PORTABLE DISPLAY DEVICE WITH INTEGRAL SUPPORT FOOT

(75) Inventor: Richard J. Repecki, West Harrison, NY (US)

(73) Assignee: Royal Consumer Products LLC, Norwalk, CT (US)

( * ) Notice: Subject to any disclaimer, the term of this patent is extended or adjusted under 35 U.S.C. 154(b) by 0 days.

(21) Appl. No.: 11/524,036

(22) Filed: Sep. 19, 2006

(65) Prior Publication Data

US 2007/0151132 A1 Jul. 5, 2007

Related U.S. Application Data

(60) Provisional application No. 60/718,531, filed on Sep. 19, 2005.

(51) Int. Cl.
*G09F 1/08* (2006.01)

(52) U.S. Cl. ..... 40/124.12; 40/124.17; 40/539

(58) Field of Classification Search ..... 40/124.12, 40/124.17, 124.15, 539, 750, 754, 755; 248/459, 248/460, 463, 465
See application file for complete search history.

(56) References Cited

U.S. PATENT DOCUMENTS 821,132 A * 5/1906 Springman ..... 248/459
1,167,031 A * 1/1916 March ..... 248/459
1,723,944 A * 8/1929 Marsh ..... 248/174
3,601,916 A * 8/1971 Epstein ..... 40/605
5,960,848 A * 10/1999 Schirer ..... 160/135

* cited by examiner

*Primary Examiner*—Cassandra Davis
(74) *Attorney, Agent, or Firm*—Ware Fressola Van Der Sluys & Adolphson LLC

(57) ABSTRACT

A portable display device has a rectangular center panel having a top edge, a bottom edge, two side hinges and a back, with first and second rectangular side panels respectively hingedly connected to the center panel by the two side hinges thereof. A support foot has a base hingedly connected to the bottom edge of the center panel and foldable to lie adjacent the back of the center panel, and first and second legs hingedly connected to the base and deployable extending rearwardly from the base and configured for releasable interconnection spaced from the base, thereby to maintain the support foot in a configuration extending rearwardly from the center panel and supporting the center and side panels in an upright position. The first and second side panels are foldable onto the display surface side of the center panel, and the base and legs of the support foot are foldable to lie adjacent the back of the center panel, wherein the portable display device has substantially the width and length of the center panel for transportation and storage.

15 Claims, 2 Drawing Sheets

PORTABLE DISPLAY DEVICE WITH INTEGRAL SUPPORT FOOT

RELATED APPLICATION

This application claims priority to my U.S. Provisional Patent Application Ser. No. 60/718,531 filed Sep. 19, 2005.

FIELD OF THE INVENTION

The invention herein relates to a portable display device of the type having a center panel and two side panels hingedly connected thereto, wherein the portable display device includes an integral folding foot that supports the device in an upright display position.

BACKGROUND OF THE INVENTION

Known portable display devices have a center panel and two side panels hingedly connected thereto to form a display surface. Information, such as text, drawings, charts, photos and the like may be placed on the display surface and the portable display device may be stood up on a flat surface to present the information on a vertical display surface. The side panels are typically angled forwardly to form props that maintain the portable display device in its vertical display position. The side panels fold onto the center panel for storage and transport of the portable display device.

Such portable display devices are shown in U.S. Pat. No. 4,794,712, U.S. Pat. No. 5,293,705, and U.S. Pat. No. 5,911,522.

When standing, the side panels of such a portable display device provide good support against tipping over in the forward direction. However, the portable display devices of this type are typically unsupported against tipping over backwards, relying on the weight of the forwardly angled side panels to prevent such backward tipping. People walking bristly past such an upright display device can create enough air current to turn it over, as can air currents from fans, open doors, or the like. Accidentally touching or pushing the portable display device can tip it over, as can leaning anything against it.

Therefore, it would be a great improvement to provide a portable display device that supports itself against backward tipping.

SUMMARY OF INVENTION

Accordingly, it is the principal object of the invention to provide a portable display device that provides good support against tipping over from an upright display position.

It is a further object of the invention herein to provide a portable display device of the foregoing character which also folds compactly for storage and transportation.

A portable display device according to the invention herein has a center panel having a top edge, a bottom edge and two side hinges, and two side panels respectively hingedly connected to the center panel by the side hinges. A support foot is integrally connected with the center panel, the support foot including a base hingedly connected to the bottom edge of the center panel and foldable to lie adjacent a back of the center panel, and first and second legs hingedly connected to the base. The first and second legs fold to extend rearwardly from the base and interconnect at or near their distal ends to configure the foot as a support extending rearwardly from the central panel.

In other aspects of the invention, the first and second legs may include intermediate fold lines establishing a leg spacer between the base panel and the distal portions of the legs. The distal ends of the legs may define a slot and tab configuration for interconnecting the legs.

In a further aspect of the invention, the support foot is hingedly connected to the center panel by a perforated fold line, so that the support foot can be readily removed from the center panel in the event that the portable display device is used in a manner that does not require a support foot.

Also according to aspects of the invention herein, the side panels are about one-half of the width of the center panel and fold over the center panel to adapt the portable display device for transportation and storage. The base and legs of the support foot also fold to positions between the side hinges of the center panel, whereby the support foot does not increase the size of the portable display device in its folded condition for transportation and storage.

Other and more specific objects and features to the invention will in part be apparent to those skilled in the art and will in part appear in the following Detailed Description of Preferred Embodiment and the Claims, taken together with the drawings.

BRIEF DESCRIPTION OF DRAWINGS

The same reference numerals refer to the same elements throughout the various figures.

DETAILED DESCRIPTION OF PREFERRED EMBODIMENT

A portable display device 10 is shown in the various figures, and it generally comprises a center panel 12, first and second side panels 14 and 16 hingedly connected to the center panel, and a foot 20 for supporting the portable display device 10 in an upright position as shown in FIGS. 1-4.

Figure 5:
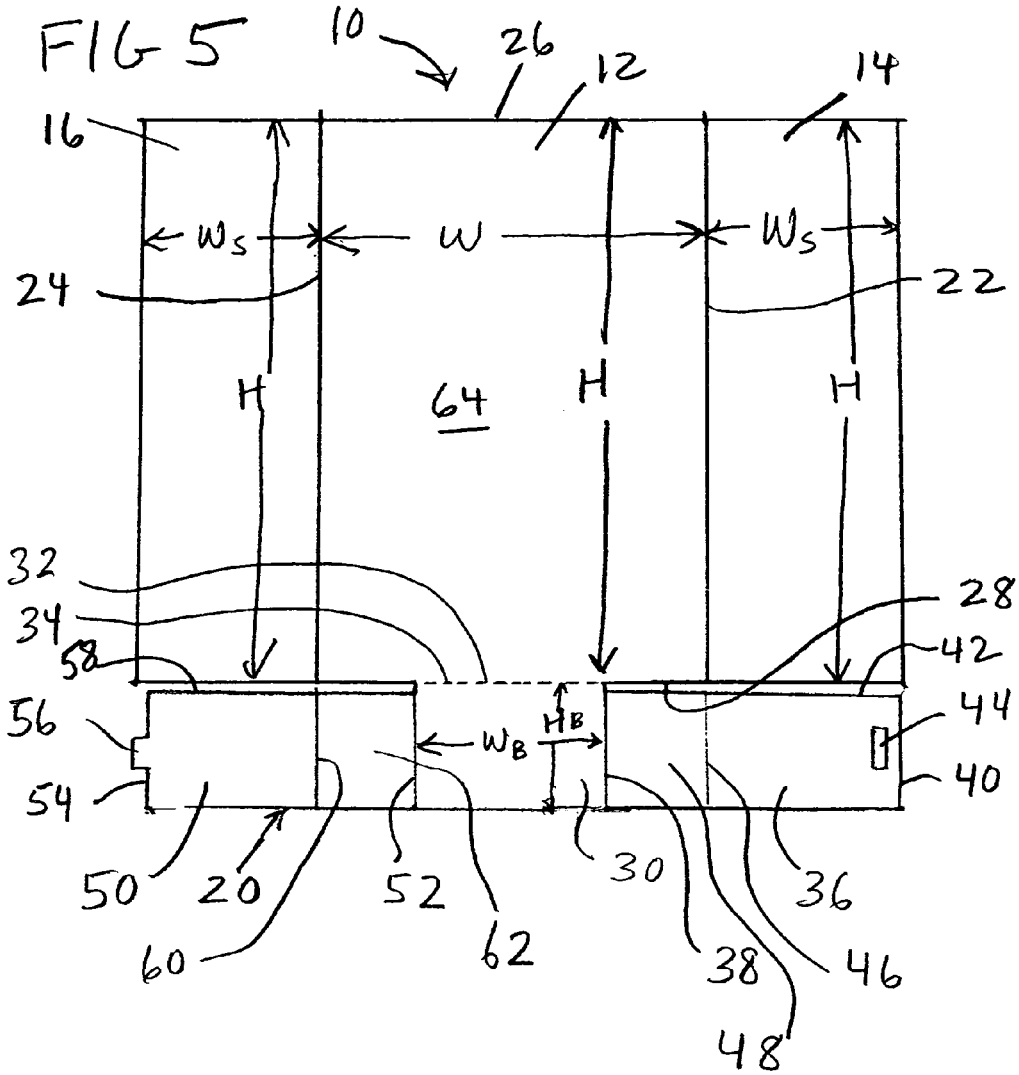
FIG. 5 is a rear plan view of the portable display device of FIG. 1, shown in its unfolded flat condition.

With reference to FIG. 5, the portable display device 10 is shown from the rear, in flat condition as it appears after manufacturing and before folding. It has a rectangular center panel 12 which, in the preferred embodiment, has a width W of 24" between a first side hinge 22 and a second side hinge 24, and a height H of 36" between a top edge 26 and a bottom edge 28.

The portable display device 10 is preferably made of a sheet of corrugated paper board, and the side hinges 22, 24 may be deformed portions of the corrugated paper board forming a fold line hinge, or may be score lines formed part way through the corrugated paper board from the back, such that the front of the corrugated material remains smooth and forms the hinges 22, 24. Other creasable and foldable paper board materials may also be used. The hinge 22 connects the center panel with side panel 14 which has the same height H as the center panel 12 and has a width $W_s$ that is preferably one half or slightly less than one half of the width W of the center panel 12. Therefore, in the example shown, the width $W_s$ of the side panel 14 is 12".

Hinge 24 is formed similarly to hinge 22, and connects the center panel 12 and the side panel 16. The side panel 16 also has the same height H as the center panel and has width $W_s$ which, in the example shown, is 12" as discussed above.

Because the hinges 22 and 24 are formed from the back 64 of the portable display device 10, the front display surface 66 thereof is continuous and smooth, with neatly appearing fold lines at the side hinges 22 and 24. If desired, a high quality paper or paper board may be laminated to the corrugated paper board, to provide a high quality display surface 66.

With continued reference to FIG. 5, the support foot 20 of the portable display device 10 has a base 30 extending from the bottom edge 28 of the center panel 12 at a central portion thereof. The base 30 is connected to the bottom edge 28 at a hinge 32, which may be a creased fold line in the corrugated paper board. In preferred embodiment shown, the fold line 32 is perforated at perforations 34, such that the support foot 12 may be optionally removed from the center panel 12 in applications of the portable display device 10 that do not require a support foot.

The base 30 is substantially rectangular and preferably has a width $W_b$ of 12", leaving a 6" space on each side of the base 30 extending to the side hinges 22 and 24. The base 30 may have a height of $H_B$ of 7".

A first leg 36 is integral with the base 30 at fold line 38, and extends to a distal end 40. The leg 36 has a bottom edge 42, with the terminology "bottom" referring to the orientation of the edge 42 when the foot 20 is deployed, as more fully discussed below. A slot 44 is formed through the leg 36, near the distal end 40 thereof, and the leg 36 is provided with another fold line 46 that is preferably aligned with the side hinge 22, to form a leg spacer potion 48.

The support foot 20 includes a second leg 50, extending from the base 30 along the bottom edge 28 of the center panel 12 and the bottom edge of the side panel 16. The leg 50 joins the base 30 at a hinge 52, which is preferably a creased fold line, and extends to a distal end 54, on which a tab 56 is provided. The leg 50 has a bottom edge 58, and is provided with an intermediary fold 60 which forms a leg spacer portion 62.

The support foot 20 may also be formed as a separate structure, with the base 30 glued or otherwise attached to the back 64 of center panel 12.

Figure 6:
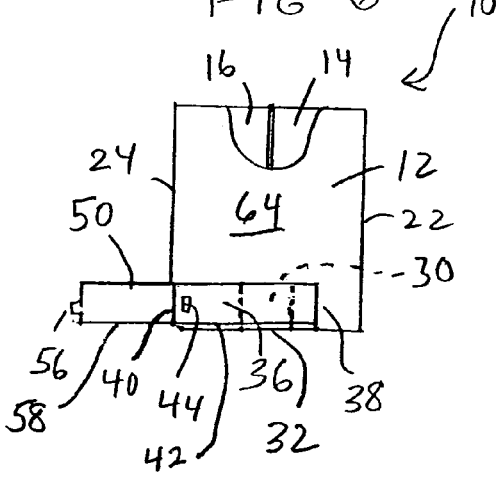
FIG. 6 is a rear plan view of the portable display device of FIG. 1, shown partially folded for transportation and storage.
Figure 7:
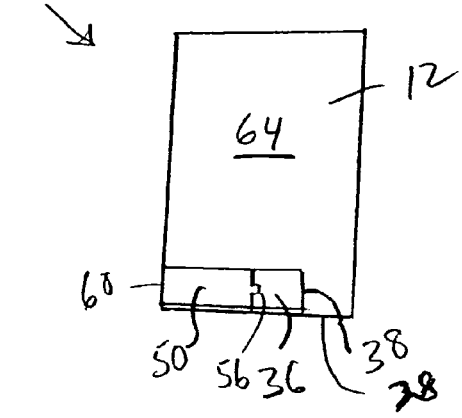
FIG. 7 is a rear plan view of the portable display device of FIG. 1, shown fully folded for transportation and storage.

With reference to FIGS. 6 and 7, the portable display device 10 may be folded to the dimensions of the center panel 12 for transportation and storage. The side panels 14 and 16 are folded to lie adjacent the center panel 12 on the front or display side 66 thereof, and because the side panels 12 and 14 have a width $W_s$ of one-half of the width W of the front panel, they are accommodated on the center panel 12 without overlapping. With particular reference to FIG. 6, the base 30 of the support foot 20 is folded to lie against the back 64 of the center panel 12, and the leg 36 is folded at hinge line 38 to also lie adjacent the back of the center panel 12. It will be appreciated that the leg 36 overlies the base 30 and the spacer portion 62 of leg 50 extending between the hinge 52 at base 30 and the fold line 60 of leg 50. Thus, the distal end 40 of leg 36 is aligned with the side hinge 24. With reference to FIG. 7, the distal portion of leg 50 between the fold line 60 and the distal end 54 thereof is folded over the leg 36, thereby to overlie leg 36 adjacent the back 64 of the center panel 12. Therefore, as shown in FIG. 7, the portable display device 10 is folded into a substantially flat configuration having the dimensions of the center panel 12.

Figure 1:
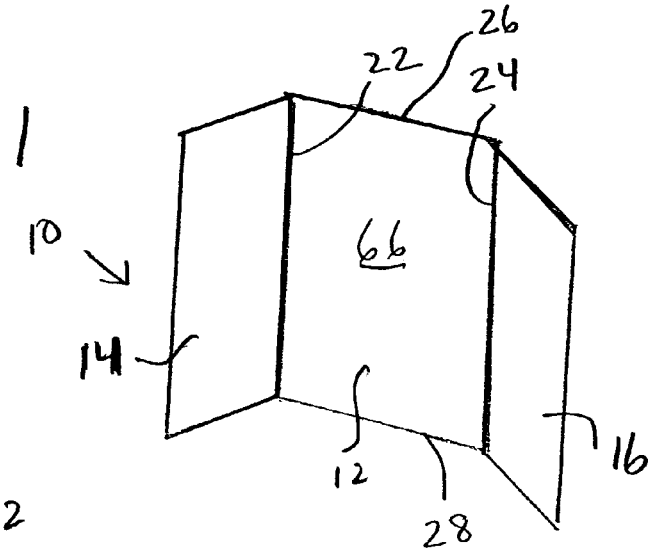
FIG. 1 is a front perspective view of the portable display device according to the invention herein, shown standing in an upright position.

With reference to FIGS. 1-4, the portable display device 10 is shown unfolded from its configuration in FIG. 7 and set up on a horizontal surface. When viewed from the front as shown in FIG. 1, the center panel 12 and side panels 14 and 16 provide the front display surface 66, and although not shown in FIG. 1, it will be understood that writings, drawings, graphs, photographs or the like may be written on or adhered to the front surface for display purposes. The side panels 14 and 16 are part of the display surface 66, and are angled forwardly with respect to center panel 12. This maintains the panels 12, 14 and 16 in their upright positions by preventing them from falling forward.

Figure 2:
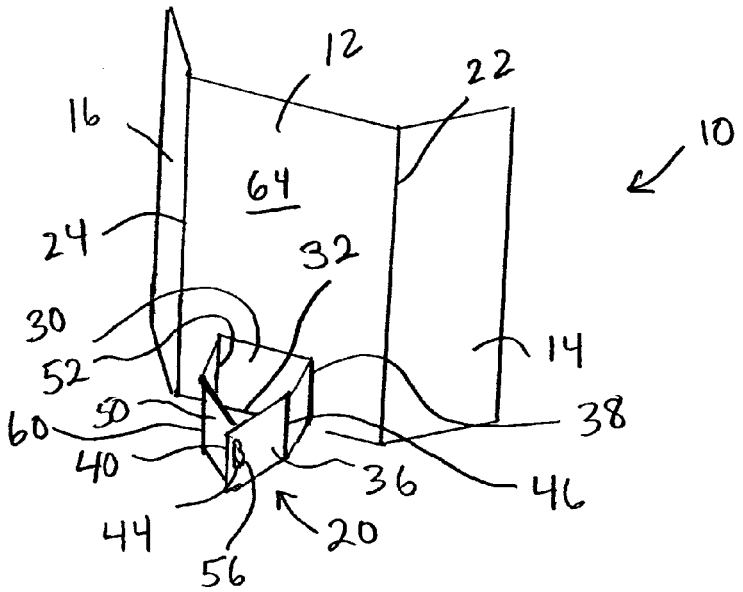
FIG. 2 is a rear perspective view of the portable display device of FIG. 1, showing a support foot thereof supporting the portable display device in upright position.
Figure 3:
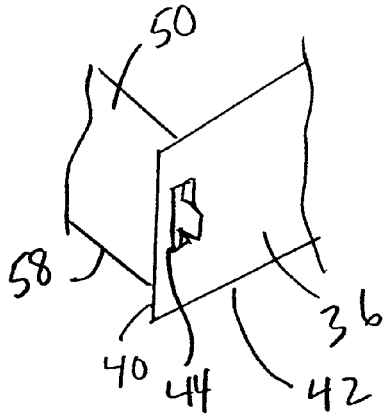
FIG. 3 is a fragmentary perspective view of the support foot of the portable display device of FIG. 1.
Figure 4:
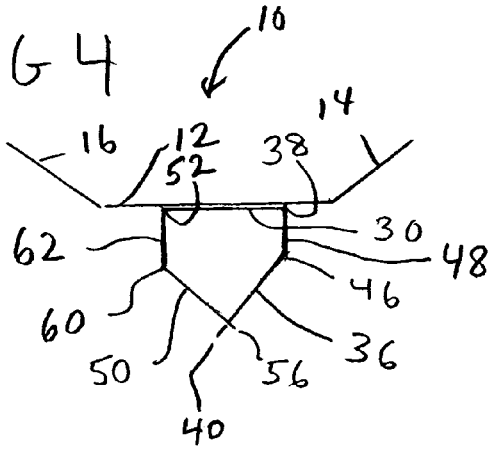
FIG. 4 is a top view of the portable display device of FIG. 1, with the support foot deployed.

With reference to FIGS. 2-4, the support foot 20 is shown deployed to prevent the portable display device 10 from tipping over backward. The base 30 of the support foot 20 is deployed adjacent the back 64 of the center panel 12, being folded along the hinge 32. The leg 36 extends rearwardly from the base 30 and center panel 12, being folded with respect to base 30 at the fold line 38 with the leg spacer portion 48 deployed generally perpendicular from the base 30. The leg 36 is further folded at the hinge 46, wherein the distal portion of leg 36 is disposed at an angle and extends generally toward the side hinge 24. The second leg 50 is folded at fold line 52 to have its spacer portion 62 extend rearwardly from the base 30 and the back 64 of the center panel 12, and is further folded at hinge 60 so that the distal end 54 of the leg 50 is deployed adjacent the distal end 40 of leg 36, where the tab 56 inserted through the slot 44. This releasably interconnects the legs 36 and 50 spaced from the hinges 38 and 52 to secure the support foot 20 in a rearwardly extending configuration as shown in FIGS. 2-4, with the bottom edges 42 and 58 of the legs 36 and 50 resting on the horizontal surface. The legs 36 and 50 may also be releasably interconnected at another location along spaced from the hinges 38 and 52. Therefore, the support foot 20 is deployed and configured to maintain the portable display device 10 and its vertical upright position and, more specifically, to prevent it from tipping over backward.

The portable display device 10 can be refolded to the configuration shown in FIG. 7 for transportation and storage.

It will be appreciated that the foregoing description of the portable display device 10 is that of a preferred embodiment, and that various changes may be made. For instance, the tab 56 and slot 44 used to secure the distal ends of legs 36 and 50 together may take a variety of other configurations, including interlocking opposing slits, or other inter-engaging configurations. Further, the legs 36 and 50 may be secured to the center panel 12 by individual bases rather than the common base 30. In another variation, the bottom edges 42, 58 of the legs 36, 50 may be angled to support the center panel 12 in a rearwardly inclined orientation, with the side panels 14 and 16 aligned with the center panel 12 to provide a wide flat display surface.

The foregoing and other changes and modifications to the preferred embodiment herein may be made by those skilled in the art without departing from the spirit and scope of the invention, which is limited only by the following claims.

The invention claimed is:

1. A portable display device comprising:

A) a center panel having a top edge, a bottom edge, two side hinges and a back;

B) first and second side panels respectively hingedly connected to the center panel by the two side hinges thereof, the center panel and first and second side panels together having a front display surface; and C) a support foot having 1) a base hingedly connected to the bottom edge of the center panel and foldable to lie adjacent the back of the center panel, and 2) first and second legs hingedly connected to the base and deployable extending rearwardly from the base and configured for releasable interconnection spaced from the base, thereby to maintain the support foot in a configuration extending rearwardly from the center panel and supporting the center and side panels in an upright position.

2. A portable display device as defined in claim 1 wherein the center panel is rectangular having a width and a height, the first and second side panels are foldable onto the display surface side of the center panel, and the base and legs of the support foot are foldable to lie adjacent the back of the center panel, wherein the portable display device has substantially the width and length of the center panel for transportation and storage.

3. A portable display device as defined in claim 2 wherein the first and second side panels have a height substantially equal to the height of the center panel and they each have a width of one-half or less the width of the center panel.

4. A portable display device as defined in claim 1 fabricated from a unitary sheet of corrugated paper board.

5. A portable display device as defined in claim 4 wherein the side hinges of the center panel connecting the side panels are creases formed from the back of the corrugated paper board.

6. A portable display device as defined in claim 4 wherein the side hinges of the center panel connecting the side panels are slits formed from the back of the unitary corrugated stock.

7. A portable display device as defined in claim 4 wherein the support foot is removable from the center panel.

8. A portable display device as defined in claim 4 wherein the base is hingedly connected to the bottom edge of the center panel by a perforated fold line, such that the support foot can be removed from the center panel by tearing the perforated fold line.

9. A portable display device as defined in claim 4 wherein the base of the support foot is a single panel of the corrugated paper board.

10. A portable display device as defined in claim 4 wherein the hinged connections between the base and the first and second legs are creases in the paper stock.

11. A portable display device as defined in claim 4 wherein the base is hingedly connected to the bottom edge of the center panel by a perforated fold line, such that the support foot can be removed from the center panel by tearing the perforated fold line.

12. A portable display device as defined in claim 1 wherein one of the legs defines a tongue at its distal end and the other support leg defines a slot adjacent its distal end for receiving the tongue for releasably interconnecting the legs.

13. A portable display device as defined in claim 1 wherein the legs have intermediary fold lines separating each of the respective legs into a leg spacer portion and a distal portion.

14. A portable display device as defined in claim 12 wherein at least one leg folds at the fold line separating the leg spacer portion and distal portion for transportation and storage of the portable display device.

15. A portable display device form of unitary corrugated paper board comprising:

A) a rectangular center panel having a top edge, a bottom edge, two side hinges and a back, the center panel having a width and a height;

B) first and second rectangular side panels respectively hingedly connected to the center panel by the two side hinges thereof, the rectangular side panels each having a height substantially the same as the height of the center panel and a width substantially one half of the width of the center panel, the center panel and first and second side panels together having a front display surface; and C) a support foot having 1) a base hingedly connected to the bottom edge of the center panel and foldable to lie adjacent the back of the center panel, and 2) first and second legs hingedly connected to the base and deployable extending rearwardly from the base, one of the legs having a slot near its distal end and the other of the legs having a tab insertable in the slot for releasable interconnection spaced from the base, thereby, to maintain the support foot in a configuration extending rearwardly from the center panel and supporting the center and side panels in an upright position, wherein the first and second side panels foldable onto the display surface side of the center panel, and the base and legs of the support foot are foldable to lie adjacent the back of the center panel, such that the portable display device has substantially the width and length of the center panel for transportation and storage.

* * * * *

UNITED STATES PATENT AND TRADEMARK OFFICE

CERTIFICATE OF CORRECTION

PATENT NO. : 7,293,380 B2
APPLICATION NO. : 11/524036
DATED : November 13, 2007
INVENTOR(S) : Richard J. Repecki It is certified that error appears in the above-identified patent and that said Letters Patent is hereby corrected as shown below:

1. In column 3, line 31 "$W_h$" should be --$W_b$--

2. In column 6, line 12, claim 14, line 1 "claim 12" should be --claim 13--

Signed and Sealed this

Sixteenth Day of December, 2008

JON W. DUDAS
*Director of the United States Patent and Trademark Office*